US008403172B1

(12) United States Patent
Kelley et al.

(10) Patent No.: US 8,403,172 B1
(45) Date of Patent: Mar. 26, 2013

(54) COLLAPSIBLE, SANITIZED STRAW ASSEMBLY

(75) Inventors: Malcom Kelley, Crawfordville, FL (US); Nordian Brown, Tallahassee, FL (US); Leitoya Snelling, Tallahassee, FL (US)

(73) Assignee: Florida A&M University, Tallahassee, FL (US)

( * ) Notice: Subject to any disclaimer, the term of this patent is extended or adjusted under 35 U.S.C. 154(b) by 0 days.

(21) Appl. No.: 13/411,690

(22) Filed: Mar. 5, 2012

Related U.S. Application Data

(63) Continuation-in-part of application No. 12/453,548, filed on May 14, 2009, now abandoned.

(51) Int. Cl.
*A47G 19/22* (2006.01)

(52) U.S. Cl. ..... 220/710; 15/105; 206/460; 206/813; 220/708; 220/212; 215/229

(58) Field of Classification Search ..... 220/705, 220/710, 708, 906, 735, 709, 212; 206/467, 206/460, 813; 15/257.01, 210.1, 105, 246, 15/209.1, 211; 215/228, 229, 6
See application file for complete search history.

(56) References Cited

U.S. PATENT DOCUMENTS 3,303,985 A 2/1967 Prokes et al.
5,076,433 A 12/1991 Howes
5,244,111 A 9/1993 Merom
5,769,263 A * 6/1998 Willingham et al. ..... 220/212
5,802,655 A * 9/1998 Denton ..... 15/209.1
5,947,289 A 9/1999 Stridsberg et al.
6,168,042 B1 1/2001 Kalagian
6,244,460 B1 6/2001 Winberg
6,254,692 B1 7/2001 Cooper
7,841,485 B1 * 11/2010 Rodriguez ..... 220/708
2002/0092857 A1 7/2002 Chang
2006/0278649 A1 12/2006 Chern
2010/0288781 A1 11/2010 Kelley et al.

* cited by examiner

*Primary Examiner* — Andrew Perreault
(74) *Attorney, Agent, or Firm* — Nilay J. Choksi; Smith & Hopen, P.A.

(57) ABSTRACT

A collapsible straw assembly. A first component includes a beverage container having a recess formed therein. A second component includes a collapsible straw having a collapsed configuration and expanded configuration. The straw is disposed in the recess when in collapsed configuration and is ready for use in expanded configuration. A third component includes a protective liner disposed in overlying relation to the straw in collapsed configuration. The liner has an outer surface containing protective materials and an inner surface containing sanitizing materials. Adhesives may be disposed on the surface of the recess and on the inner surface of the liner. When in the collapsed configuration, the inner end of the straw can be attached to the container, and the outer end of the straw can be attached to the liner. This allows simultaneous expansion of the straw when the liner is removed to expose the straw.

15 Claims, 5 Drawing Sheets

COLLAPSIBLE, SANITIZED STRAW ASSEMBLY

CROSS-REFERENCE TO RELATED APPLICATIONS

This application is a continuation-in-part of and claims priority to U.S. patent application Ser. No. 12/453,548, entitled "Container/Drinking Straw Combination", filed on May 14, 2009 by the same inventor, the contents of which are hereby incorporated by reference into this disclosure.

BACKGROUND OF THE INVENTION

1. Field of the Invention

This invention relates, generally, to an assembly or combination of a beverage container and drinking straw. More particularly, it relates to a beverage container as a unitary packaging combination with a drinking straw that is removably attached to said beverage container.

2. Description of the Prior Art

The prior art discloses drinking straws separately packaged for later use when a user wishes to insert a drinking straw into a container to consume a beverage. However, this arrangement (i.e., separation of straw and container) is a cumbersome one as it requires additional effort to associate the drinking straw with the beverage container when the user wishes to consume the beverage contents.

Further, rigid drinking straws are not efficient in retrieving beverage contents from a container as these drinking straws are characterized by an inflexibility that does not enable adequate reach into all areas of the container.

Combination units of drinking straws and beverage containers are known in the art, for example U.S. Pat. No. 6,244,460 to Winberg, U.S. Pat. No. 5,076,433 to Howes, U.S. Pat. No. 3,303,985 to Prokes, and U.S. Pat. No. 5,244,111 to Merom. Winberg discloses a flattened, folded straw secured to the bottom recess of a beverage can with a protective device attached in overlying relation to protect the straw. Howes discloses a prize delivery system concealed within a food container. Prokes discloses a disposable beverage dispensing container including a sipping straw for removal of the beverage, wherein the straw is enclosed in a tear strip that is adhered to the container. Merom discloses beverage can cleaner attached to a beverage can, the cleaner used to clean the circumferential groove of the top of the beverage can.

However, these references neither include any ability to sanitize a straw in a container-straw combination nor provide sufficient ease of usability. Often users want to sanitize a straw prior to use, particularly straws that might be manufactured with the beverage container, in order to clean any debris from the manufacturing process and any adhesive remnants that allow attachment of the straw to the container. Users may not have a sanitizing wipe at hand to clean the straw when needed in use.

Accordingly, what is needed is a unitary combination of beverage container and straw that is packaged as a single unit or item, said straw being cleansable and sufficiently flexible to retrieve liquid contents from all areas of the container. However, in view of the art considered as a whole at the time the present invention was made, it was not obvious to those of ordinary skill how the art could be advanced.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

The long-standing but heretofore unfulfilled need for an improved, more effective and lower cost unitary beverage container and drinking straw assembly is now met by a new, useful and nonobvious invention.

The straw is removably coupled to the container, such that minimum effort is needed to remove the straw to render it capable of being sanitarily wiped prior to placing it into the container. Moreover, the straw is sufficiently flexible that when inserted into the container, the straw can retrieve beverage contents from all areas of the container. The present invention facilitates consumption of a beverage and provides easy access for consumption of a beverage from a container.

An objective of the current invention is to provide a customer with a unitary beverage container/straw combination sanitarily packaged as a single unit or item.

Another objective is to provide a customer with a unitary beverage container/straw combination packaged as a single unit or item, in which the straw is removably attached so that a minimum amount of effort is employed to remove that straw to render it capable of being sanitarily wiped prior to placing it in the container.

A further objective of the invention is to provide a beverage container that provides a customer with a beverage container/straw combination, packaged as a single unit or item, in which the straw is removably attached so that a minimum amount of effort is employed to remove the straw to render it capable of being sanitarily wiped by pulling on a tab or enclosure which encloses the straw, so as to extend or elongate the compactly removably attached straw to enable the straw to have adequate flexibility to retrieve the beverage from all areas of the container.

An embodiment of the current invention includes a collapsible straw assembly, said assembly comprising three components. The first component includes a beverage container having a recess formed therein and an aperture through which liquid content can flow. The second component includes a collapsible straw having a collapsed configuration and expanded configuration. The straw is disposed in the recess when in its collapsed configuration. The third component includes a protective liner disposed in overlying relation to the straw when the straw is in its collapsed configuration. The edges of the protective liner are sealed to the container within the container's recess or to create the recess on the container. The liner encloses and protects the straw from the external environment. The liner has an outer surface and inner surface. The outer surface faces the external environment and contains protective materials. The inner surface faces the straw and container and contains sanitizing materials.

The assembly may include an adhesive disposed on a surface of the recess. When in its collapsed configuration, the inner end of the straw can be attached to the container via this adhesive. The assembly may further include a covering capped on the inner end of the straw to protect that end from the adhesive materials.

The assembly may include an adhesive disposed on an inner surface of the liner. When in its collapsed configuration, the outer end of the straw can be attached to the liner via this adhesive. The assembly may further include a covering capped on the outer end of the straw to protect that end from the adhesive materials.

The assembly may include adhesives on both the surface of the recess and on the inner surface of the liner. When in its collapsed configuration, the inner end of the straw can be attached to the container, and the outer end of the straw can be attached to the liner. This allows simultaneous straightening/expansion of the straw when the liner is being peeled off of the container to expose the straw. The assembly may further include coverings capped on both the inner end and the outer end of the straw to protect the ends from the adhesive materials.

The assembly may include a covering disposed over the entirety of the straw and enclosing the straw.

When in its collapsed configuration, the straw may be substantially flat and include a plurality of overlapping folds to facilitate enclosure by the liner.

The straw may include a plurality of ridged sections and plurality of smooth sections to enhance flexibility.

The straw may include a single ridged section disposed along the substantial entirety of the straw to enhance flexibility.

The container may be a standard beverage can, and in such a case, the recess may be the curved bottom side of the can.

When in its collapsed configuration, the straw may have a circular orientation about the recess.

The recess may be formed by the edges of the liner being sealed to a planar surface of the container, creating a recess therein sufficiently large enough to contain the straw in collapsed configuration.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1A:
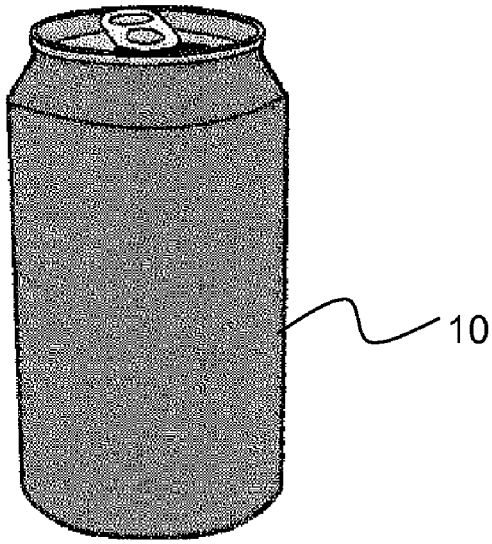
FIG. 1A depicts a side view of a beverage can as an example of a beverage container.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

Certain embodiments of the current invention include a combination of a container and drinking straw. The combination comprises, generally, a beverage container, a compressed/folded straw, and a protective liner disposed in overlying relation to the straw and secured to the container. The protective liner further includes an inner surface that has sanitizing ability, so a user can clean the container and/or straw prior to use.

When a user wishes to disconnect the straw from the container-straw combination/assembly to drink a beverage from the container, the user removes the protective liner by pulling on the protective liner or pulling on a table connected to the protective liner. Upon removal of the protective liner, the user may remove the folded/compressed straw from the container and straighten/expand the straw to create a channel therein, through which the beverage can flow while in use.

The beverage container can take any known form, including, but not limited to, a beverage can, a bottle and a disposable cup.

The straw can be securedly disposed adjacent to the container on any surface of the container as the protective liner is the mechanism by which the straw can remain in place. For example, the straw can be secured in the bottom recess of a beverage can by sealing the protective liner to the bottom recess of the can in overlying relation to the straw. Similarly, the straw can be secured to the side of a beverage bottle by sealing the protective liner to the side of the bottle in overlying relation to the straw. Sealing the protective liner to the side of the bottle would create a recess therein in which the straw could snugly remain.

The straw is collapsible and has at least two configurations, a collapsed configuration and an expanded configuration. The collapsed configuration includes any configuration in which the straw is condensed and can fit in a recess of the container (or recess created by the protective liner). For example, the straw can include a plurality of folds that allows it to be substantially flat. Alternatively, the straw can be disposed in a circular orientation within the recess. The expanded configuration is a configuration in which a user may use the straw to consume the contents of the container. Generally, the expanded configuration is established upon separation of the straw and protective liner from the container prior to use by the user.

Various types of straws can be used in the current invention. An embodiment includes straight straws with no flexible accordion-like ridges. This type of straw may be folded until it is substantially flat and can remain in its collapsed configuration. When straightened into its expanded configuration, the straw would be rigid, relatively inflexible and hold up to use by the user. Another embodiment includes straws with a plurality of sections containing flexible accordion-like ridges. This type of straw may be compressed to its smallest size and oriented circularly in its collapsed configuration. When straightened into its expanded configuration (i.e., ridges extended), the straw would be rigid, relatively flexible and hold up to use by the user. This straw can be useful to retrieve liquid contents from all areas of the container. Another embodiment includes a single section containing flexible accordion-like ridges. The section would be disposed along the substantial entirety of the straw. When straightened into its expanded configuration (i.e., ridges extended), the straw would be rigid, relatively flexible and hold up to use by the user. This straw can be useful to retrieve liquid contents from all areas of the container.

The protective liner is substantially flat, and has am outer planar side/surface and an inner planar side/surface. When the protective liner is secured to the container (i.e., straw is in the collapsed configuration), the outer planar surface faces the external environment, and the inner planar surface faces the recess created therein. The outer planar surface includes any known flexible protective material, for example plastic, aluminum, etc. The inner planar surface includes any known sanitizing substance that is safe to human touch, for example cloth moistened in antibacterial solution. A user would utilize the inner planar surface of the protective liner to wipe or sanitize the straw upon separation of the straw and protective liner from the container and prior to insertion of the straw into the container for consumption of the liquid contents therein.

The protective liner can be sealed onto the container by any known adherence method, such as heat-sealing, thermal bonding or pressure bonding.

The recess within which the straw is disposed may have an adhesive attached to its surface. A first end of the straw (e.g., an innermost fold of the straw) may be adhered to the adhesive when the straw is in its collapsed configuration. This allows the straw to be securedly attached to the container. Another adhesive may be disposed on the inner surface of the protective liner. A second end of the straw (e.g., outermost fold of the straw) may be adhered to the adhesive when the straw is in its collapsed configuration. An embodiment of the current invention includes two adhesives, one placed on the recess surface and the other placed on the inner surface of the protective liner. The first end of the straw is attached to the recess adhesive, and the second end of the straw is attached to the protective liner adhesive. This embodiment allows particular functionality such that when the protective liner is peeled off of the container, the straw is simultaneously expanded/straightened into its expanded configuration.

The current invention may further include a covering capping the first end of the straw if an adhesive is included on the recess surface. The covering protects the first (i.e., attached) end of the straw from any adhesive materials. The current invention may further include a covering capping the second end of the straw if an adhesive is included on the inner surface of the protective liner. The covering protects the second (i.e., attached) end of the straw from any adhesive materials. If adhesives are disposed on both the recess surface and inner surface of the protective liner, then both the first end and the second end of the straw may be capped with coverings to protect them from any adhesive materials. Alternatively, a covering may be included that covers the entirety of the straw to completely protect the straw, even upon separation from the container.

The covering may be made of any suitable materials, including, but not limited to, paper and plastic. The adhesive can be formed of any known adhering materials or methods, for example heat or thermal bonding.

EXAMPLE 1

Figure 1B:
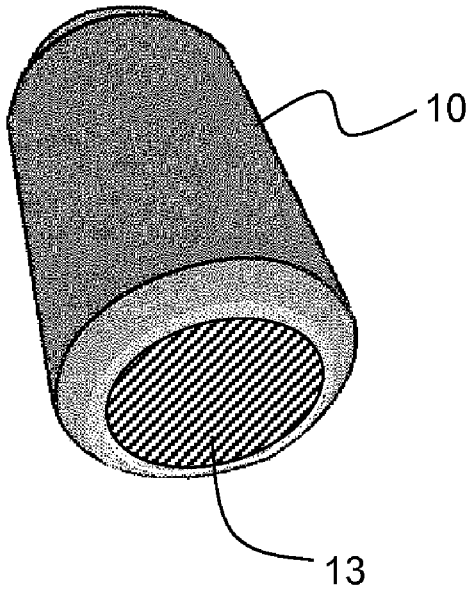
FIG. 1B depicts a bottom perspective view of a beverage container with enclosure disposed on a recess of the container.

A beverage can is depicted as beverage container 10 in FIG. 1A. FIG. 1B depicts the bottom of beverage container 10 with enclosure 13 disposed in overlying relation to a recess (not shown in this figure).

Figures 2A, 2B, 2C, 2D:
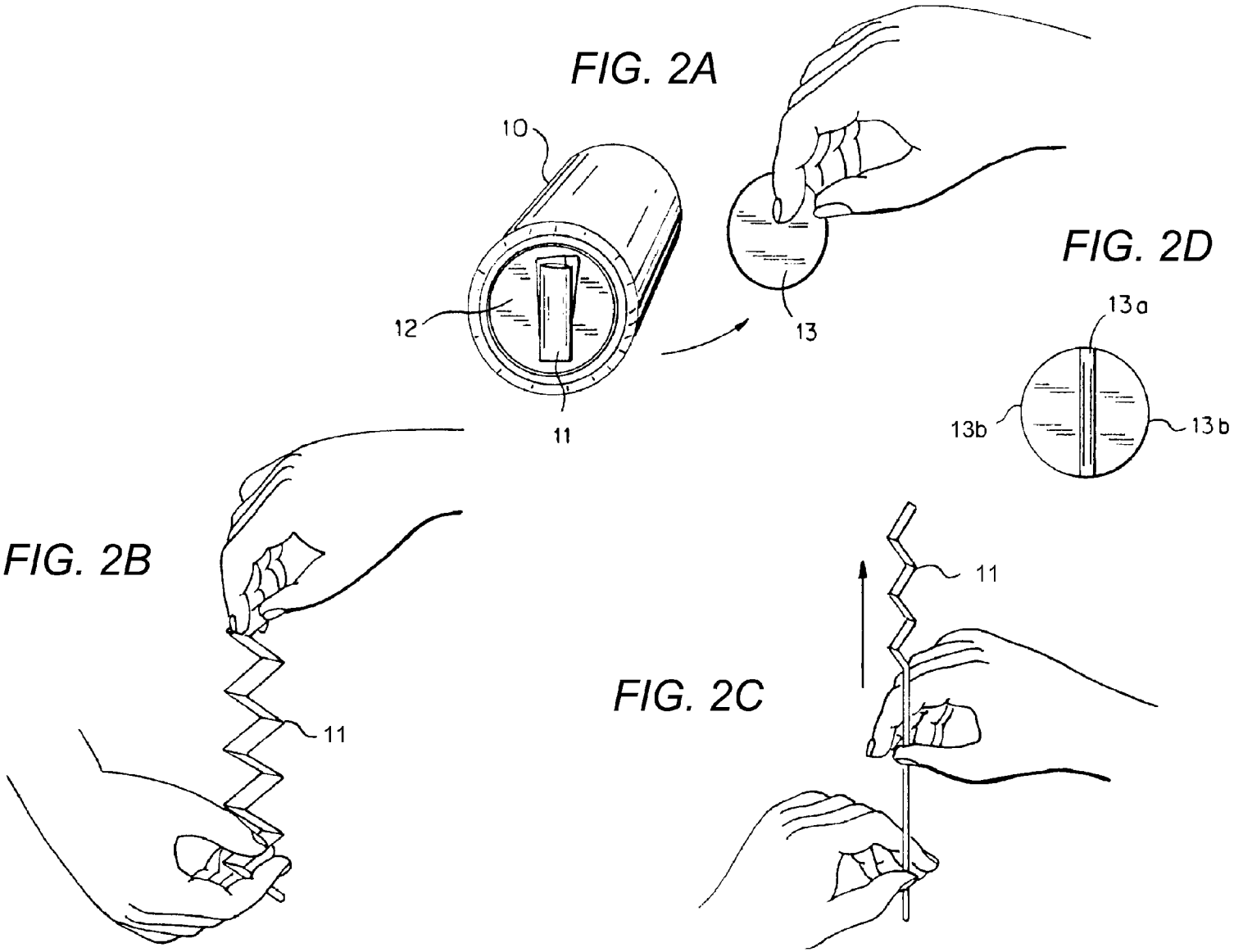
FIG. 2A depicts a bottom perspective view of a beverage container after an attached enclosure is removed to expose a collapsed straw.
FIG. 2B depicts a straw partially unfolded after detachment from a beverage container.
FIG. 2C depicts a user straightening or expanding a straw for use upon removal from a beverage container to which the straw was previously attached.
FIG. 2D depicts the inner surface of an enclosure that was removed from a container.

As depicted in FIG. 2A, enclosure 13 may be removed or peeled off of container 10 to expose recess 12 and collapsed straw 11. Collapsed straw 11 includes overlapping folds and is removably secured in recess 12 of beverage container 10. Collapsed straw 11 may also be adhesively attached to recess 12 to facilitate removal of collapsed straw 11 from container 10. Collapsed straw 11 may also be adhesively attached to enclosure 13 on the inner surface of enclosure 13 via strip 13*a*, as seen in FIG. 2D. If collapsed straw 11 is adhesively attached to both recess 12 and enclosure 13, then collapsed straw 11 may be unfolded/expanded simultaneous to enclosure 13 being removed from container 10.

As depicted in FIG. 2B, upon removal of collapsed straw 11 from recess 12 of container 10, straw 11 can be partially unfolded to commence opening the channel therein. The channel within straw 11 is fully opened, as shown in FIG. 2C, by straightening or elongating straw 11.

As depicted in FIG. 2D, the inner surface of enclosure 13 includes sanitized cloth 13*b* for sanitizing or cleaning straw 11 and container 10 prior to inserting straw 11 into container 10 for consumption of liquid contents within container 10. Upon expansion of straw 11, sanitizing cloth 13*b* from enclosure 13 can be used to sanitize straw 11 prior to use.

Figure 5A:
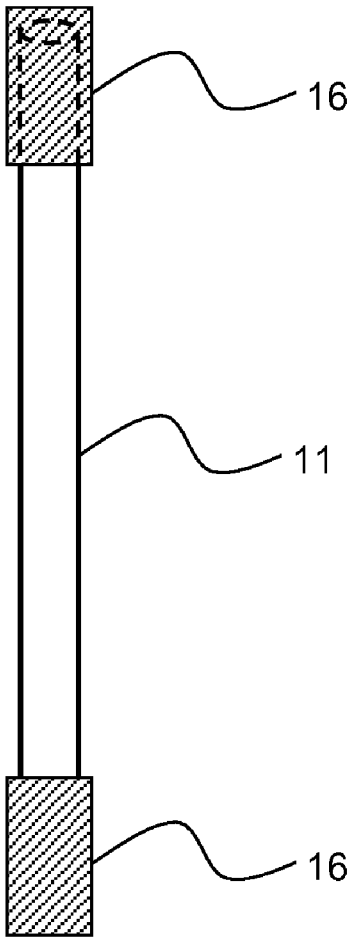
FIG. 5A depicts a casing disposed in covering relation over the ends of an expanded straw.
Figure 5B:
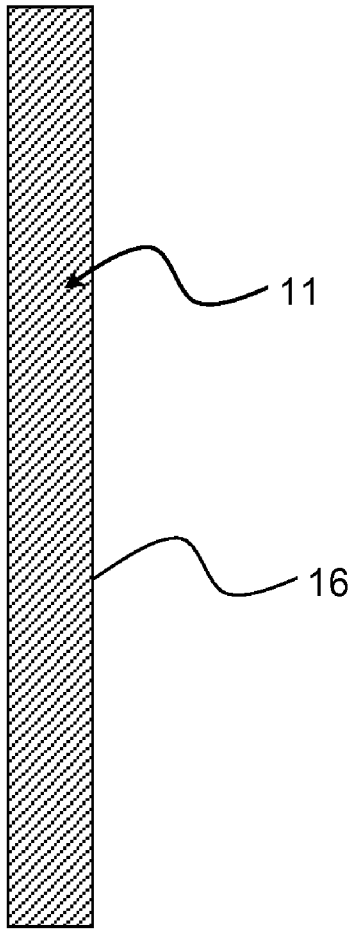
FIG. 5B depicts a casing disposed in covering relation over the entirety of an expanded straw.

As depicted in FIGS. 5A-B, straw 11 may include one or more casings 16 disposed in covering relation to the ends of straw 11 or along the entirety of straw 11. Casings 16 may be made of any protective material, for example plastic or paper, and protect straw 11 from any adhesive remnants or other debris.

EXAMPLE 2

A beverage can is depicted as beverage container 10 in FIG. 1A. FIG. 1B depicts the bottom of beverage container 10 with enclosure 13 disposed in overlying relation to a recess (not shown in this figure).

Figures 3A, 3B, 3C:
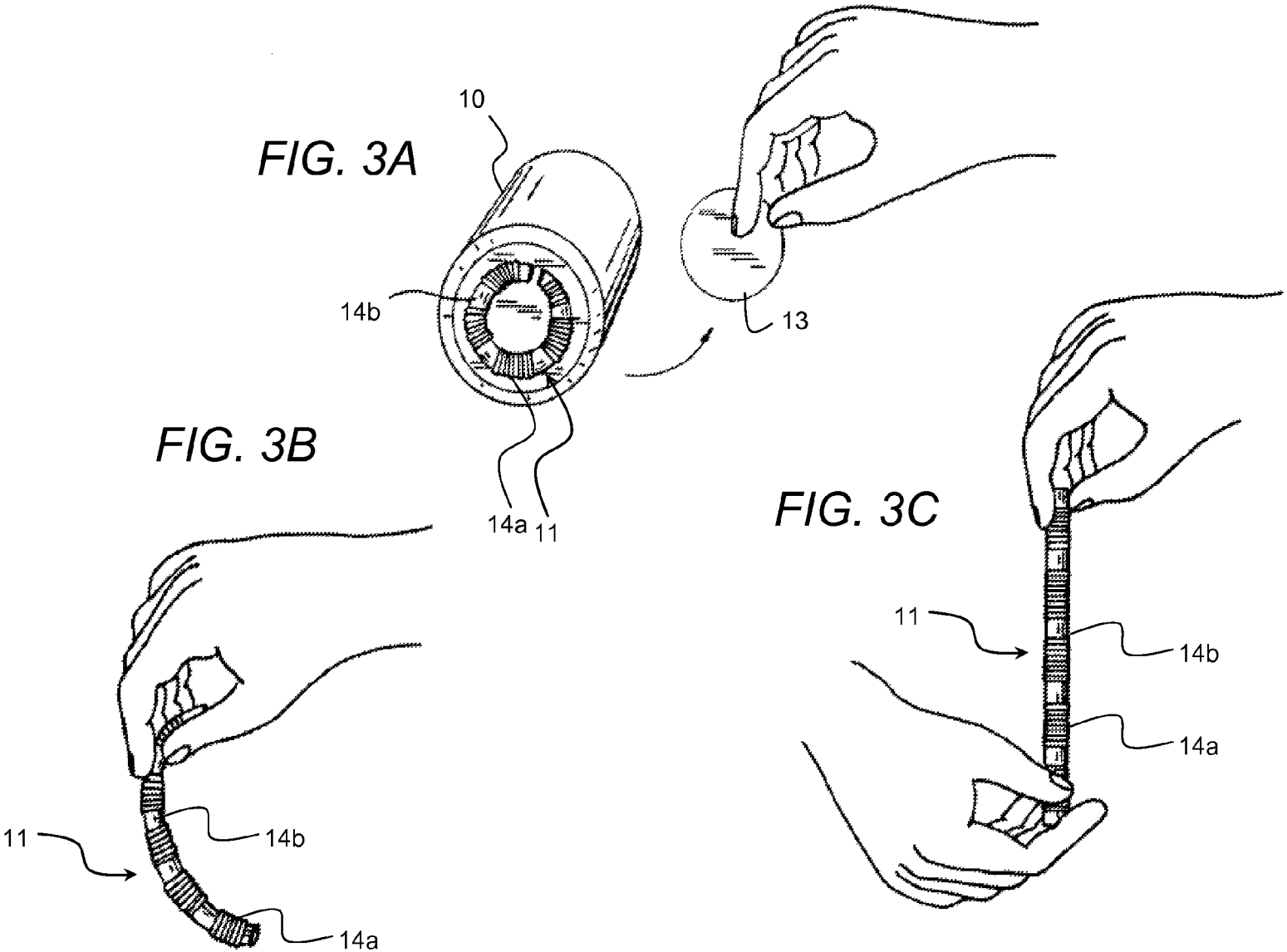
FIG. 3A depicts a bottom perspective view of a beverage container after an attached enclosure is removed to expose a collapsed straw.
FIG. 3B depicts a straw partially unfolded after detachment from a beverage container.
FIG. 3C depicts a user straightening or expanding a straw for use upon removal from a beverage container to which the straw was previously attached.

As depicted in FIG. 3A, enclosure 13 may be removed or peeled off of container 10 to expose recess 12 and collapsed straw 11. Collapsed straw 11 is compressed at plurality of ridged sections 14*a* and is removably secured in recess 12 of beverage container 10 in a circular orientation. Collapsed straw 11 may also be adhesively attached to recess 12 to facilitate removal of collapsed straw 11 from container 10. Collapsed straw 11 may also be adhesively attached to enclosure 13 on the inner surface of enclosure 13 via strip, not shown but similar to strip 13*a* seen in FIG. 2D. If collapsed straw 11 is adhesively attached to both recess 12 and enclosure 13, then collapsed straw 11 may be expanded simultaneous to enclosure 13 being removed from container 10.

As depicted in FIG. 3B, upon removal of collapsed straw 11 from recess 12 of container 10, straw 11 can be partially expanded to commence elongation of straw 11 and expansion of the channel therein. Straw 11 is expanded by stretching of plurality of ridged sections 14*a*. The channel within straw 11 is fully expanded longitudinally, as shown in FIG. 3C, by straightening or elongating straw 11.

Enclosure 13 includes an inner surface containing a sanitizing cloth, not shown but similar to sanitizing cloth 13*b* seen in FIG. 2D, for sanitizing or cleaning straw 11 and container 10 prior to inserting straw 11 into container 10 for consumption of liquid contents within container 10. Upon expansion of straw 11, sanitizing cloth, not shown, from enclosure 13 can be used to sanitize straw 11 prior to use.

As depicted in FIGS. 5A-B, straw 11 may include one or more casings 16 disposed in covering relation to the ends of straw 11 or along the entirety of straw 11. Casings 16 may be made of any protective material, for example plastic or paper, and protect straw 11 from any adhesive remnants or other debris.

EXAMPLE 3

A beverage can is depicted as beverage container 10 in FIG. 1A. FIG. 1B depicts the bottom of beverage container 10 with enclosure 13 disposed in overlying relation to a recess (not shown in this figure).

Figures 4A, 4B, 4C:
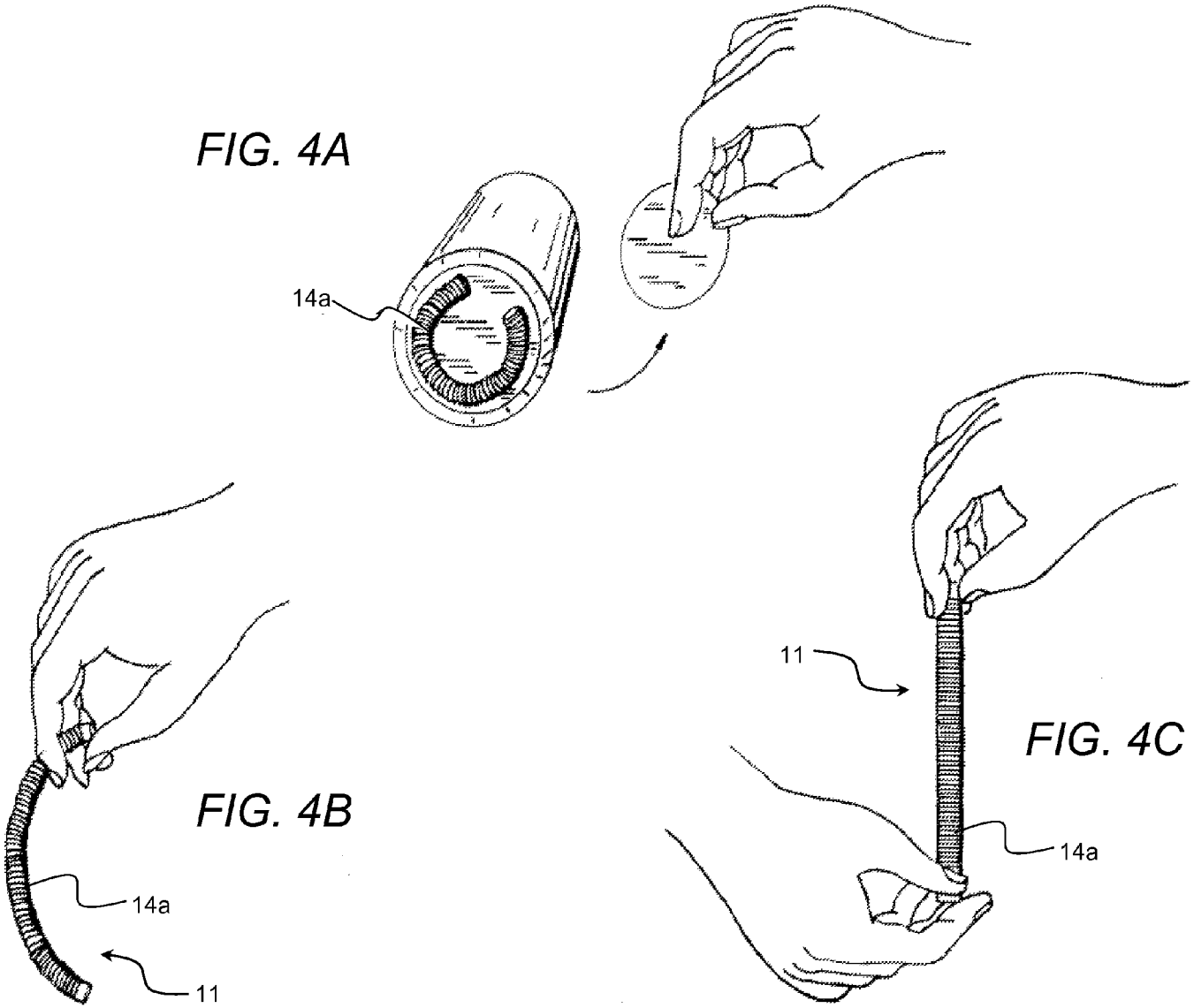
FIG. 4A depicts a bottom perspective view of a beverage container after an attached enclosure is removed to expose a collapsed straw.
FIG. 4B depicts a straw partially unfolded after detachment from a beverage container.
FIG. 4C depicts a user straightening or expanding a straw for use upon removal from a beverage container to which the straw was previously attached.

As depicted in FIG. 4A, enclosure 13 may be removed or peeled off of container 10 to expose recess 12 and collapsed straw 11. Collapsed straw 11 is compressed at ridged section 14*a* disposed along the substantial entirety of straw 11 and is removably secured in recess 12 of beverage container 10 in a circular orientation. Collapsed straw 11 may also be adhesively attached to recess 12 to facilitate removal of collapsed straw 11 from container 10. Collapsed straw 11 may also be adhesively attached to enclosure 13 on the inner surface of enclosure 13 via strip, not shown but similar to strip 13*a* seen in FIG. 2D. If collapsed straw 11 is adhesively attached to both recess 12 and enclosure 13, then collapsed straw 11 may be expanded simultaneous to enclosure 13 being removed from container 10.

As depicted in FIG. 4B, upon removal of collapsed straw 11 from recess 12 of container 10, straw 11 can be partially expanded to commence elongation of straw 11 and expansion of the channel therein. Straw 11 is expanded by stretching of ridged section 14*a*. The channel within straw 11 is fully expanded longitudinally, as shown in FIG. 4C, by straightening or elongating straw 11.

Enclosure 13 includes an inner surface containing a sanitizing cloth, not shown but similar to sanitizing cloth 13*b* seen in FIG. 2D, for sanitizing or cleaning straw 11 and container 10 prior to inserting straw 11 into container 10 for consumption of liquid contents within container 10. Upon expansion of straw 11, sanitizing cloth, not shown, from enclosure 13 can be used to sanitize straw 11 prior to use.

As depicted in FIGS. 5A-B, straw 11 may include one or more casings 16 disposed in covering relation to the ends of straw 11 or along the entirety of straw 11. One or more casings 16 may be made of any protective material, for example plastic or paper, and protect straw 11 from any adhesive remnants or other debris.

Glossary of Claim Terms

The term "adhesive" is used herein to refer to any substance that provides or promotes attachment between two objects. Examples include, but are not limited to, glue, liquid latex, epoxy, tape, etc. In the present invention, the first end of the straw may be attached to the recess surface via glue, and/or the second end of the straw may be attached to the inner surface of the protective lining via glue.

The term "circular orientation" is used herein to refer to an arrangement of a straw in its collapsed configuration, wherein the straw is positioned in a circle or portion of a circle.

The term "collapsed configuration" is used herein to refer to any orientation in which a straw can remain stable and secure adjacent or attached to a beverage container with a protective liner disposed in overlying relation thereto. The current invention can be manufactured as a single unit with a straw in this collapsed configuration.

The term "collapsible" is used herein to refer to the ability to undergo any reduction in size (i.e., reduction in area covered). For example, a straw may be collapsible if it can be folded to form smaller dimensions. A straw may also be collapsible if it can be compressed to smaller dimensions.

The term "component" is used herein to refer to a smaller, self-contained part of the overall invention. Thus, if an assembly contains three components, the invention requires the three self-contained parts to come together to form the invention.

The term "container" is used herein to refer to any structure in which objects, materials or substances can be stored or transported. A container generally includes a base, sides and top, and can take any shape or form. For example, a container may have a circular base, cylindrical sides and circular top, and enclose liquid content.

The term "covering" is used herein to refer to any protective material used to enclose a particular aspect of the current invention. The covering is used to protect its enclosed aspect from the environment external the border of its enclosure.

The term "enclose" is used herein to refer to holding, containing or surrounding an aspect of the current invention. For example, a straw is enclosed within a recess when it is surrounded by the surface of the container and the inner surface of the protective liner.

The term "expanded configuration" is used herein to refer to any orientation in which a straw can be used by a user to facilitate the consumption of liquid contents within a container. In an expanded configuration, a straw may have higher flexibility to retrieve liquid contents from all areas within a container.

The term "external environment" is used herein to refer to any area that is outside of an enclosed space. For example, if a straw is enclosed within a recess of a container, the external environment would be the area outside of the recess.

The term "flexibility" is used herein to refer to the quality of being capable of flexing, bending, turning, bowing, and twisting without breaking A straw is flexible when it can bend about various areas of the container from which it is facilitating the consumption of liquid contents.

The term "folds" is used herein to refer to any bend or crease within a structure. A straw has a plurality of folds when it has bends in overlapping relation to place the straw in its collapsed configuration.

The term "liquid content" is used herein to refer to any substance that is flowing and readily willing to change its relative position. For example, liquid content in the current invention may be a soft drink, water, etc.

The term "overlying relation" is used herein to refer to a position of a protective liner relative to a straw that the protective liner is securing. As defined herein, the beverage container is used as the base and thus the protective liner is disposed in overlying relation to the straw. For example, even if the recess is a curved bottom side of a beverage can, a protective liner can be sealed underneath the straw (relative to the beverage can standing straight up) but still be considered disposed in overlying relation thereto.

The term "planar side" is used herein to refer to a flat longitudinal aspect of a protective liner. The protective liner may have two planar sides that may take any form or shape depending on recess to which it is sealed or straw to which it is disposed in overlying relation.

The term "protect" is used herein to refer to covering or shielding a structure from exposure, damage or destruction. Thus, a protective liner protects a straw from the environment external to the recess to which the protective liner is adhered. A covering protects a straw from adhesive materials within the recess.

As used herein, the terms "protective lining" and "protective liner" are used interchangeably to refer to a removable cover disposed in overlying relation to a straw in collapsed configuration and protecting such straw. When the protective liner is removed, the straw is exposed and can be handled by a user.

The term "protective material" is used herein to refer to any substance that can be used to hinder exposure, damage or destruction to a structure. Thus, a protective liner having a surface that includes protective material may contain any substance that can be used to hinder exposure, damage or destruction to the straw that that protective liner is protecting.

The term "recess" is used herein to refer to any space formed within a structure or created on a structure by a separate structure. For example, a beverage may have its own recess along its curved bottom side, or the edges of a planar lining can be sealed along the side of a beverage bottle, thereby creating a recess therein. The recess must be sufficiently large enough to contain a straw in a collapsed configuration.

The term "ridged section" is used herein to refer to a segment of a structure that has a plurality of peaks and troughs. Ridged sections can be compressed, wherein the peaks may abut each other, and expanded, wherein the peaks and troughs have shallower apexes.

The term "sanitizing material" is used herein to refer to any substance that can partially free a structure of microorganisms by cleaning or disinfecting. Examples include, but are not limited to, antibacterial solution. Because the sanitizing material might touch the straw to be used by the user or touch the user himself/herself, the sanitizing material must be safe to human touch.

The term "seal" is used herein to refer to closing a structure or recess securely to prevent leakage into or out of the sealed area. Thus, if a protective liner is sealed to the surface of a container, the protective liner prevents leakage into or out of the recess therein.

The term "smooth section" is used herein to refer to any segment of a structure that has no ridges. Thus, smooth sections themselves cannot compress or expand.

The term "straw" is used herein to refer to a long plastic or paper tube with channel formed therein through which liquid contents may be consumed by suction. A straw may have a collapsed configuration for storage or expanded configuration for use.

The term "substantial entirety" is used herein to refer to the whole length or a significant length of a straw. Having a single ridged section along a substantial entirety of a straw allows the straw to be flexible and collapsible since the ridged section would constitute a significant length of a straw.

The term "substantially flat" is used herein to refer to the width of a collapsed straw sufficient to allow the straw to be contained stably within a recess of the container by a protective liner.

The term "surface" is used herein to refer to the planar boundaries or layers of an object. Thus, a flat object, such as a protective liner, has two surfaces (e.g., layers), each of which containing a different substance that can remain separate.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A collapsible straw assembly, comprising:

a container adapted to hold a liquid fluid;

a recess formed in said container;

an aperture formed in said container through which said liquid fluid can flow;

a collapsible straw having a first end and a second end;

said straw having a collapsed configuration and an expanded configuration;

said straw disposed within said recess of said container when said straw is in said collapsed configuration;

a protective lining disposed in overlying relation to said collapsible straw when said straw is in said collapsed configuration;

said protective lining sealed to a surface of said recess to enclose said straw and protect said straw from an external environment when said straw is in said collapsed configuration;

said protective lining having an outer planar side and an inner planar side;

said outer planar side facing said external environment and including a protective material;

said inner planar side facing said straw when said straw is in said collapsed configuration and including a sanitizing material, wherein said sanitizing material is used to sanitize said straw when said straw is in said expanded configuration;

a first adhesive disposed on said surface of said recess;

a means of securing said first end of said straw to said container via said first adhesive in said recess when said straw is in said collapsed configuration; and a second adhesive disposed on said inner planar side of said protective lining;

a means of securing said second end of said straw to said protective lining via said second adhesive on said inner planar side of said protective lining when said straw is in said collapsed configuration.

2. A collapsible straw assembly as in claim 1, further comprising:

a covering disposed on said first end of said straw to protect said first end from said first adhesive, said covering being in direct contact with said first adhesive to facilitate said means of securing said first end of said straw to said container.

3. A collapsible straw assembly as in claim 1, further comprising:

a covering disposed on said second end of said straw to protect said second end from said second adhesive, said covering being in direct contact with said second adhesive to facilitate said means of securing said second end of said straw to said protective lining.

4. A collapsible straw assembly as in claim 1, further comprising:

a first covering disposed on said first end of said straw to protect said first end from said first adhesive, said covering being in direct contact with said first adhesive to facilitate said means of securing said first end of said straw to said container; and a second covering disposed on said second end of said straw to protect said second end from said second adhesive, said covering being in direct contact with said second adhesive to facilitate said means of securing said second end of said straw to said protective lining.

5. A collapsible straw assembly as in claim 1, further comprising:

a covering disposed over the entirety of said straw to facilitate said means of securing said first end of said straw to said container and to facilitate said means of securing said second end of said straw to said protective lining.

6. A collapsible straw assembly as in claim 1, wherein:

said straw, when in said collapsed configuration, is substantially flat and includes a plurality of overlapping folds to facilitate enclosure by said protective lining.

7. A collapsible straw assembly as in claim 1, wherein:

said straw includes a plurality of ridged sections and a plurality of smooth sections to enhance flexibility of said straw.

8. A collapsible straw assembly as in claim 1, wherein:

said straw includes one ridged section disposed along the substantial entirety of said straw to enhance flexibility of said straw.

9. A collapsible straw assembly as in claim 1, wherein:

said container is a beverage can; and said recess is disposed on a bottom surface of said beverage can.

10. A collapsible straw assembly as in claim 1, wherein:

said straw has a circular orientation within said recess of said container when said straw is in said collapsed configuration.

11. A collapsible straw assembly as in claim 1, wherein:

said recess is formed by said protective lining being sealed to a planar surface of said container.

12. A collapsible straw assembly, comprising:

a container adapted to hold a liquid fluid;

a recess formed at the bottom of said container;

a first adhesive disposed on a surface of said recess;

an aperture formed in said container through which said liquid fluid can flow;

a collapsible straw having a first end and a second end;

a covering disposed over the entirety of said straw, said covering protecting said straw;

said straw having a collapsed configuration and an expanded configuration;

said straw having a circular orientation and disposed within said recess of said container when said straw is in said collapsed configuration;

said covering on said first end of said straw attached to said container via said first adhesive in said recess when said straw is in said collapsed configuration;

said covering detachable from said first adhesive;

a protective lining disposed in overlying relation to said collapsible straw when said straw is in said collapsed configuration, said protective lining sealed to a surface of said recess to enclose said straw and protect said straw from an external environment when said straw is in said collapsed configuration, said protective lining having an outer planar side and an inner planar side, said outer planar side facing said external environment and including a protective material, said inner planar side facing said straw when said straw is in said collapsed configuration and including a sanitizing material, wherein said sanitizing material is used to sanitize said straw when said straw is in said expanded configuration, a second adhesive disposed on said inner planar side of said protective lining, said covering on said second end of said straw attached to said protective lining via said second adhesive on said inner planar side of said protective lining when said straw is in said collapsed configuration.

13. A collapsible straw assembly as in claim 12, wherein:

said straw, when in said collapsed configuration, is substantially flat and includes a plurality of overlapping folds to facilitate enclosure by said protective lining.

14. A collapsible straw assembly as in claim 12, wherein:

said straw includes a plurality of ridged sections and a plurality of smooth sections to enhance flexibility of said straw.

15. A collapsible straw assembly as in claim 12, wherein:

said straw includes one ridged section disposed along the substantial entirety of said straw to enhance flexibility of said straw.

* * * * *

UNITED STATES PATENT AND TRADEMARK OFFICE

CERTIFICATE OF CORRECTION

PATENT NO. : 8,403,172 B1
APPLICATION NO. : 13/411690
DATED : March 26, 2013
INVENTOR(S) : Malcolm Kelly et al.

It is certified that error appears in the above-identified patent and that said Letters Patent is hereby corrected as shown below:

On the Title Page, Item (75) Inventors: should read

--(75) Inventors: Malcolm Kelly, Crawfordville, FL (US); Nordian Brown, Tallahassee, FL (US); Leitoya Snelling, Tallahassee, FL (US)

Signed and Sealed this
Thirteenth Day of August, 2013

Teresa Stanek Rea
*Acting Director of the United States Patent and Trademark Office*